US007066086B1

(12) United States Patent
Endo et al.

(10) Patent No.: US 7,066,086 B1
(45) Date of Patent: Jun. 27, 2006

(54) STENCIL PRINTER

(75) Inventors: Toshihiro Endo, Amimachi (JP); Yasuo Yamamoto, Amimachi (JP); Tadayuki Wakatabi, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 298 days.

(21) Appl. No.: 09/639,850

(22) Filed: Aug. 16, 2000

(30) Foreign Application Priority Data

Aug. 16, 1999 (JP) ..... 11/229615

(51) Int. Cl.
*B41F 15/00* (2006.01)
*F04B 43/00* (2006.01)

(52) U.S. Cl. ..... 101/114; 101/123; 101/124; 101/126; 101/483; 417/412; 417/413.1

(58) Field of Classification Search ..... 101/114, 101/123, 124, 483, 126; 417/413.1, 412; 267/140
See application file for complete search history.

(56) References Cited

U.S. PATENT DOCUMENTS 3,843,974 A * 10/1974 Miller et al. ..... 101/123
3,973,491 A * 8/1976 Porth et al. ..... 101/124
4,030,366 A * 6/1977 Kazahaya et al. ..... 73/406
4,051,777 A * 10/1977 Black et al. ..... 101/123
4,066,240 A * 1/1978 Atkinson et al. ..... 251/175
4,111,056 A * 9/1978 Mastromatteo ..... 73/706
4,173,185 A * 11/1979 Voegelin ..... 101/120
4,372,208 A 2/1983 Legardinier
4,610,658 A * 9/1986 Buchwald et al. ..... 604/9
4,819,973 A * 4/1989 Pegon ..... 285/332.3
4,924,905 A * 5/1990 Mastromatteo ..... 137/510
5,019,202 A * 5/1991 Kawahata et al. ..... 101/114
5,165,340 A * 11/1992 Karlyn et al. ..... 101/126
5,263,693 A * 11/1993 Klein ..... 267/140
5,620,746 A 4/1997 Snyder, Jr.
5,826,516 A * 10/1998 Shimazu et al. ..... 101/483
6,030,851 A * 2/2000 Grandmont et al. ..... 438/53

FOREIGN PATENT DOCUMENTS

| | | |
|---|---|---|
| DE | 196 38 961 | 3/1998 |
| EP | 0 640 492 | 3/1995 |
| JP | 3-23676 | 3/1991 |
| JP | 10-268 | 11/1998 |

* cited by examiner

*Primary Examiner*—Andrew H. Hirshfeld
*Assistant Examiner*—Marvin P. Crenshaw
(74) *Attorney, Agent, or Firm*—Nixon Peabody LLP; Donald R. Studebaker

(57) ABSTRACT

In a stencil printer, a diaphragm pump is used as an ink supply pump.

7 Claims, 3 Drawing Sheets

STENCIL PRINTER

BACKGROUND OF THE INVENTION

1. Field of the Invention

This invention relates to a stencil printer, and more particularly to a pump for supplying ink to an ink supply roll of a stencil printer.

2. Description of the Related Art

A stencil printer generally comprises a printing drum which is provided with an ink-permeable peripheral wall and an ink supply roll disposed in the peripheral wall. A stencil master is wound around the peripheral wall of the printing drum and printing ink is supplied to the stencil master by the ink supply roll in response to rotation of the printing drum. As a pump for supplying ink to the ink supply roll, there has been employed a piston pump or a plunger pump.

When ultraviolet ray curing ink is used in a stencil printer, curing of the ink at a part where friction by sliding is applied to the ink can cause trouble. When the ink cures, excessive load is applied to the pump and the pump can finally become unworkable. Accordingly, the material of the ink has to be carefully selected.

SUMMARY OF THE INVENTION

In view of the foregoing observations and description, the primary object of the present invention is to provide a stencil printer having an ink supply pump which can suppress curing or gelation of ink irrespective of the material of the ink.

In accordance with the present invention, there is provided a stencil printer comprising an ink supply pump in the form of a diaphragm pump.

It is preferred that the diaphragm pump be arranged to be stopped in a position where the stress applied to the diaphragm is not larger than 75% of the elastic limit of the diaphragm. Further it is preferred that the maximum stress applied to the diaphragm is not larger 75% of the elastic limit of the diaphragm.

It is further preferred that the diaphragm is of a material whose swelling ratio to the ink is not larger than 1.05.

Though the ink need not be limited to ultraviolet ray curing ink, the stencil printer of this invention is especially useful for ultraviolet ray curing ink.

In the stencil printer of the present invention, since the ink supply pump is a diaphragm pump, no friction by sliding is applied to the ink and accordingly, curing or gelation of the ink can be suppressed even if the ink is ultraviolet ray curing ink.

A stencil printer is operated under a wider variety of environmental conditions as compared with other office machines and sometimes is not operated for months. Accordingly, when the diaphragm is of rubber, deterioration•deformation of rubber is generated and it becomes difficult to keep the performance of the pump. By arranging the diaphragm pump to be stopped in a position where the stress applied to the diaphragm is not larger than 75% of the elastic limit of the diaphragm, deterioration•deformation of the diaphragm can be suppressed and the initial performance of the pump can be held for a long time.

Further, when the diaphragm is of a material whose swelling ratio to the ink is not larger than 1.05, the ink can be stably supplied for a long time. When the swelling ratio to the ink of the diaphragm is larger than 1.05, the diaphragm is deformed and it becomes difficult to keep the initial performance of the pump.

DESCRIPTION OF THE PREFERRED EMBODIMENT

Figure 1:
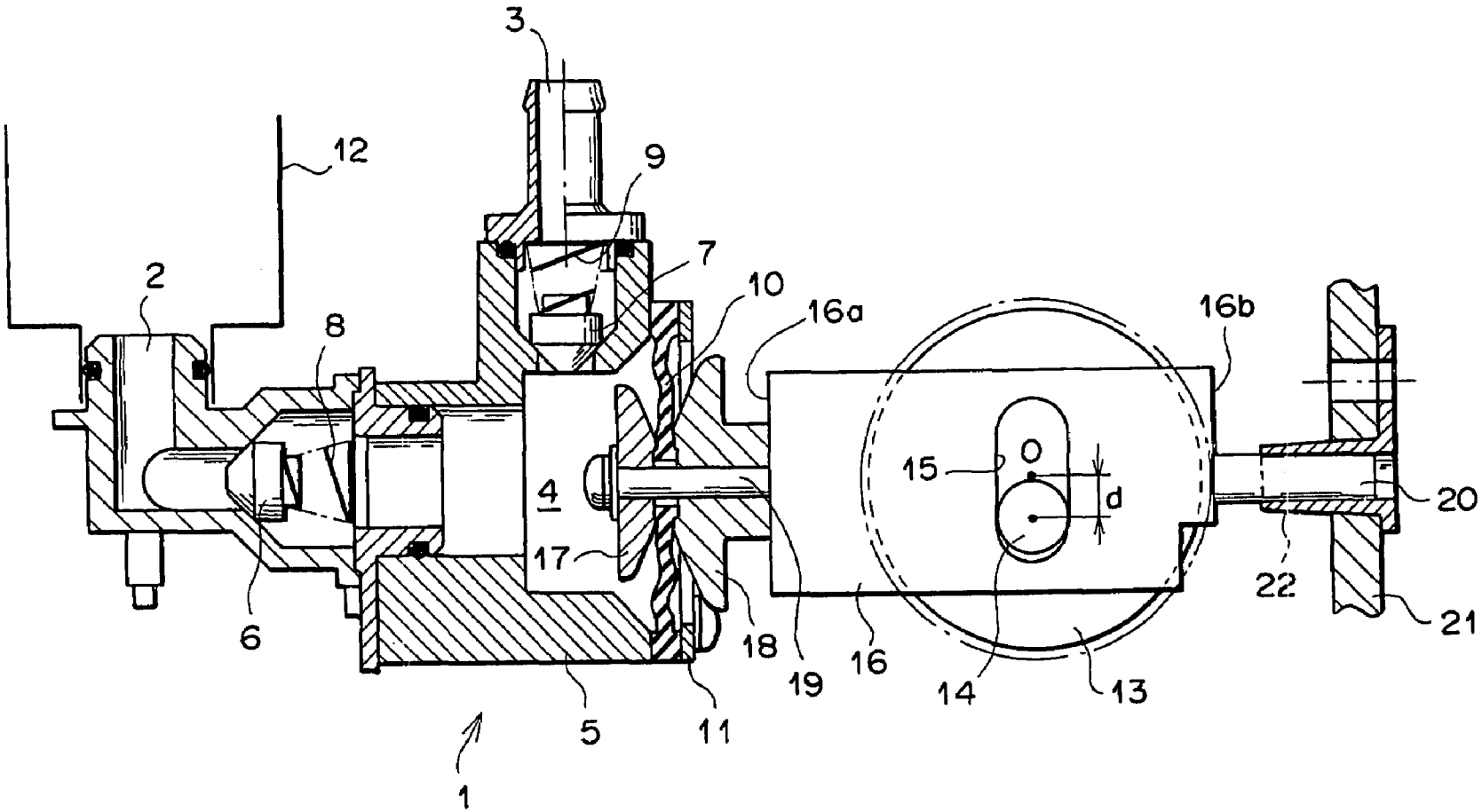
FIG. 1 is a fragmentary cross-sectional view of a stencil printer in accordance with an embodiment of the present invention showing a state of the ink supply pump where it stops with no stress on the diaphragm.

In FIG. 1, a stencil printer in accordance with an embodiment of the present invention comprises a diaphragm pump 1 as an ink supply pump. The diaphragm pump 1 comprises pump housing 5 in which an ink intake port 2, an ink discharge port 3 and a pump chamber 4 are formed. An ink bottle 12 is mounted on the ink intake port 2 and ink is supplied to the stencil printer through the ink discharge port 3. An intake-side check valve 6 which permits the ink to flow from the ink bottle 12 to the pump chamber 4 and does not permit the ink to flow in the reverse direction is provided in the passage between the ink intake port 2 and the pump chamber 4. A discharge-side check valve 7 which permits the ink to flow from the pump chamber 4 to the ink discharge port 3 and does not permit the ink to flow in the reverse direction is provided in the passage between the ink discharge port 3 and the pump chamber 4. The check valves 6 and 7 are normally closed by coiled springs 8 and 9, respectively. A disc-like diaphragm 10 is disposed on the side of the pump chamber 4 remote from the ink intake port 2 and faces the pump chamber 4. The diaphragm 10 is fixed to the pump housing 5 by a ring 11 at the peripheral edge thereof.

The diaphragm 10 is driven by a mechanism comprising a gear 13 which is rotated by an electric motor (not shown), an eccentric cam 14 which is fixed to the gear 13 at a distance d from the axis of rotation O of the gear 13, and a cam follower 16 which is provided with an opening 15 in engagement with the eccentric cam 14 and is moveable left and right in perpendicular to the surface of the diaphragm 10.

The opening 15 of the cam follower 16 is elongated in the vertical direction in perpendicular to the direction in which the cam follower 16 is moved back and forth, and as the gear 13 rotates, the eccentric cam 14 is rotated about the axis of rotation O of the gear 13 while moving left and right the cam follower 16 in a stroke of **2*d* by way of the engagement between the eccentric cam 14 and the opening 15**.

A central portion of the diaphragm 10 is pinched between a pair of mounting plates 17 and 18, and the mounting plates 17 and 18 are fixed to a surface **16*a* of the cam follower 16 opposed to the diaphragm 10 by way of a bold 19 which extends through the diaphragm 10 and the mounting plates 17 and 18 at the center thereof, whereby the central portion of the diaphragm 10 is connected to the cam follower 16**.

A guide rod 20 extends from the surface of the cam follower **16*b* opposite to the surface 16*a* in a direction in which the cam follower 16 is move back and forth and is slidably fitted in a sleeve 20 mounted on a stationary frame 21, whereby the cam follower 16 is moved back and forth under the guidance of the guide rod 22**.

In the state shown in FIG. 1, the eccentric cam 14 is just below the axis of rotation O of the gear 13 and accordingly the diaphragm 10 is positioned in a neutral position where no stress is applied to the diaphragm 10.

Figure 2:
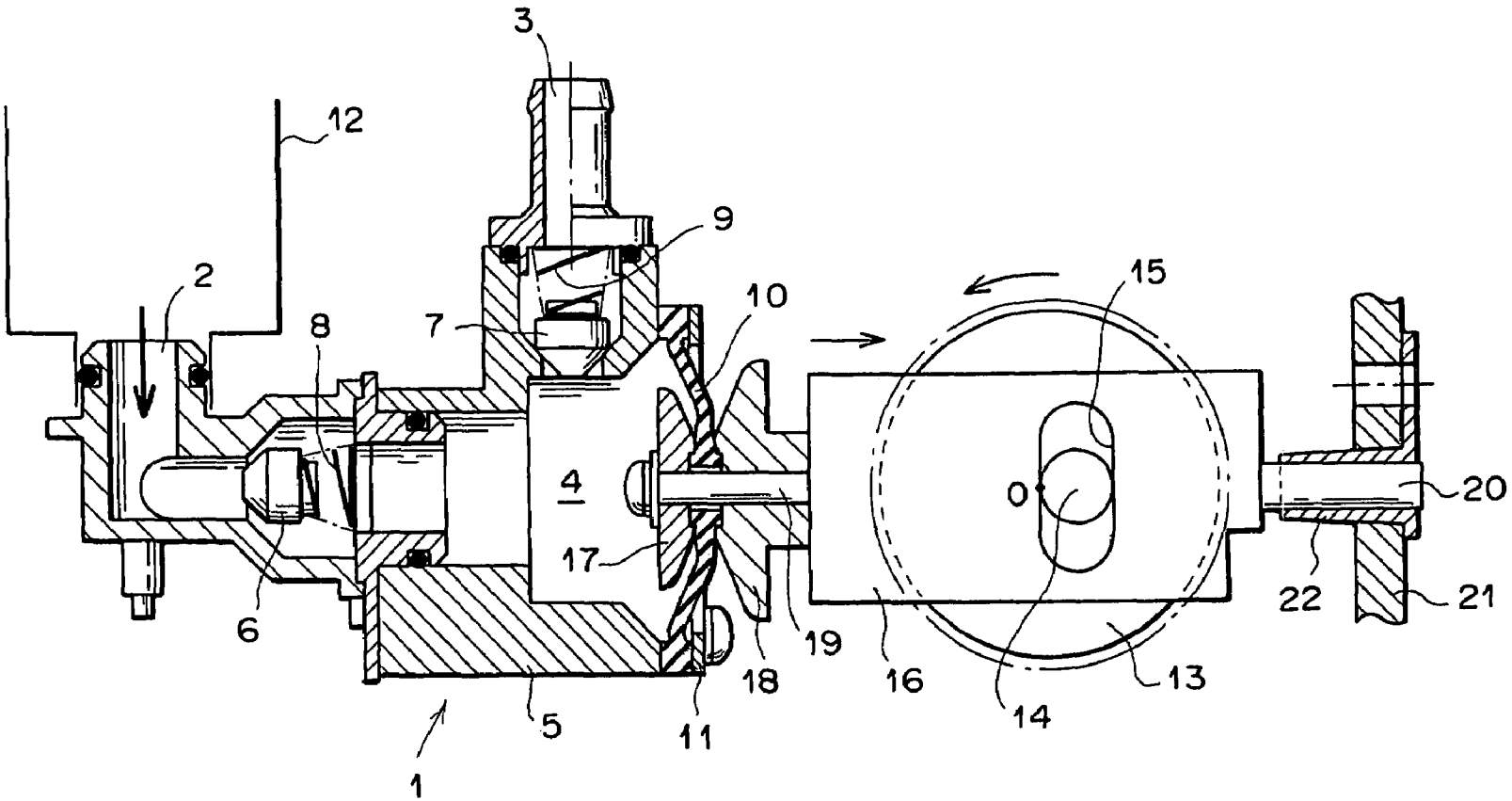
FIG. 2 is a fragmentary cross-sectional view of the stencil printer showing a state of the ink supply pump where it is taking in the ink.

When that the amount of ink on an ink supply roll (not shown) becomes smaller than a predetermined value is electrically detected, the gear 13 is rotated in the counter-clockwise direction in FIG. 1 to move the eccentric cam 14 rightward of the axis of rotation O of the gear 13 and the cam follower 16 is moved rightward in FIG. 1, whereby the diaphragm 10 is deformed rightward as shown in FIG. 2 to increase the volume of the pump chamber 4 and the intake-side check valve 6 is opened overcoming the force of the spring 8 so that the ink in the ink bottle 12 is introduced into the pump chamber 4.

Figure 3:
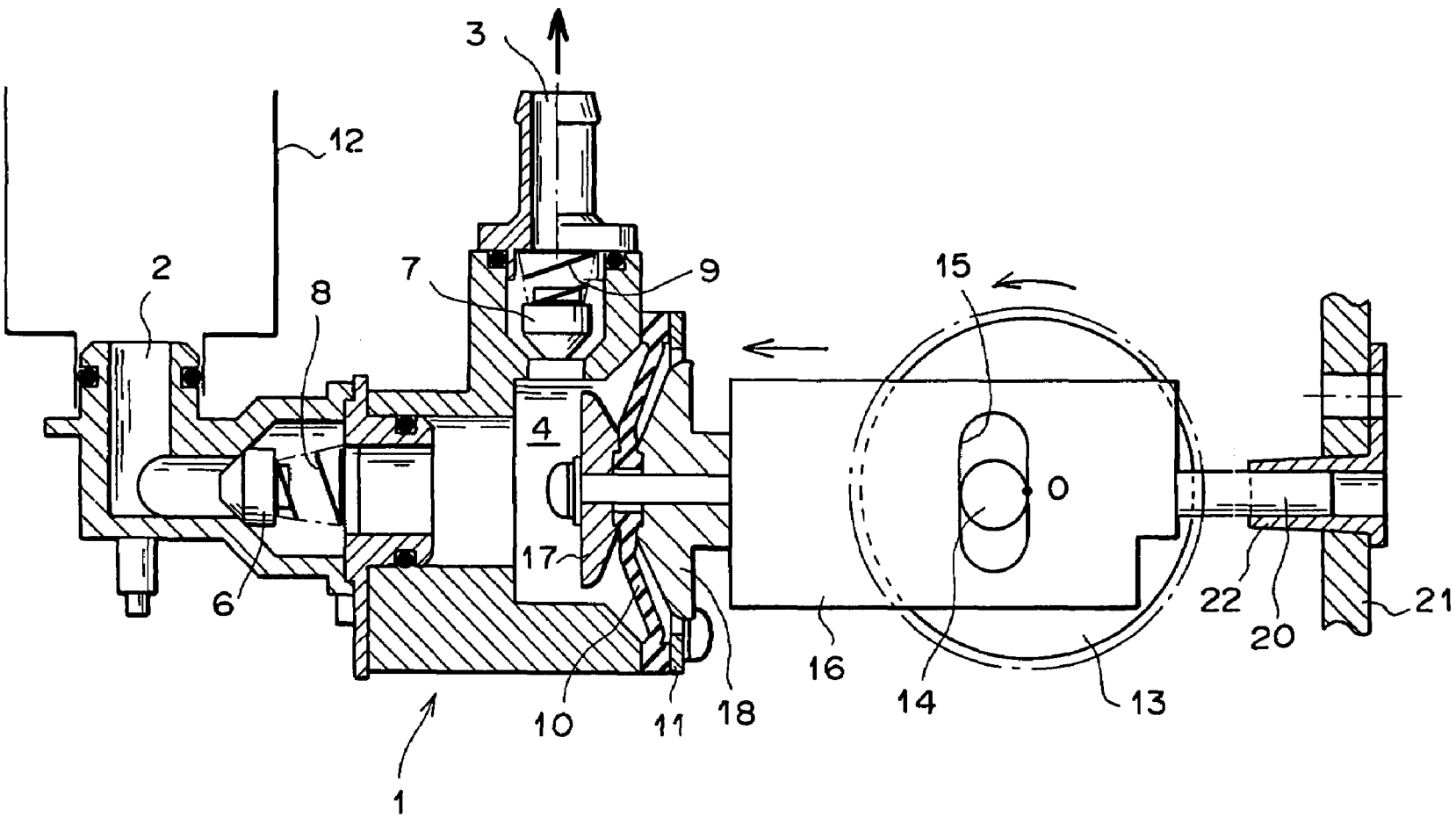
FIG. 3 is a fragmentary cross-sectional view of the stencil printer showing a state of the ink supply pump where it is discharging the ink.

When the eccentric cam 14 is moved leftward of the axis of rotation O of the gear 13 passing above the axis of rotation O as shown in FIG. 3, the cam follower 16 is moved leftward and the diaphragm 10 is deformed leftward to reduce the volume of the pump chamber 4, whereby the discharge-side check valve 7 is opened overcoming the force of the spring 9 and the ink inside the pump chamber 4 is discharged toward the stencil printer through the ink discharge port 3.

When the amount of ink on the ink supply roll reaches a predetermined value, the gear 13 is stopped and the pump 1 is stopped.

When the diaphragm 10 is stopped at this time in a position where the stress applied to the diaphragm 10 is not larger than 75% of the elastic limit of the diaphragm 10, deterioration•deformation of the diaphragm 10 can be suppressed and the initial performance of the pump 1 can be held even if the pump 1 is kept stopped for a long time.

For example, the diaphragm 10 can be stopped in a desired position by mounting a position sensor on the gear 13 and stopping the gear 13 in a predetermined position.

The following table 1 shows the relation between the position in which the diaphragm 10 was stopped (in the term of the percentage to the stress corresponding to the elastic limit) and deformation•deterioration of the diaphragm 10 after the pump was stopped for three months at 23° C. The diaphragm 10 was of EPDM (ethylene-propylene-diene-methylene) rubber.

TABLE 1

| position of the diaphragm (percentage to elastic limit) | deformation · deterioration (pump performance) |
|---|---|
| 0% | ○ |
| 25% | ○ |
| 50% | ○ |
| 75% | Δ |
| 80% | x |
| 100% | x |

wherein ○ represents that the diaphragm 10 was not deformed,
Δ represents the diaphragm 10 was somewhat deformed but the pump performance was kept to be acceptable,
and x represents that the diaphram 10 was deformed to such an extent that the pump performance was unacceptable.

wherein ○ represents that the diaphragm 10 was not deformed, Δ represents the diaphragm 10 was somewhat deformed but the pump performance was kept to be acceptable, and x represents that the diaphragm 10 was deformed to such an extent that the pump performance was unacceptable.

As can be understood from table 1, when the diaphragm 10 is stopped for a long time in a position where the stress applied to the diaphragm 10 is larger than 75% of the elastic limit of the diaphragm 10, the initial performance of the pump 1 cannot be held due to deterioration•deformation of the diaphragm 10.

By setting the distance d of the eccentric cam 14 from the axis of rotation O of the gear 13 so that the maximum stress applied to the diaphragm 10 is not larger 75% of the elastic limit of the diaphragm 10, deterioration•deformation of the diaphragm 10 can be suppressed wherever the gear 13 is stopped.

As the ink, ultraviolet ray curing ink of the composition shown in the following table 2 was used.

TABLE 2

| | |
|---|---|
| oligomer (epoxy acrylate oligomer) | 20 parts |
| monomer 1 (dipentaerythritol hexaacrylate) | 34 parts |
| monomer 2 (phenyl-ethylene oxide denatured acrylate) | 34 parts |
| pigment (furnace carbon black) | 4 parts |
| photo-initiator | 3 parts |
| viscosity adjustment agent | 3 parts |
| dispersant | 1 part |
| polymerization inhibitor | 0.1 part |

The following table 3 shows the relation between the material (swelling ratio) of the diaphragm 10 and deformation•deterioration of the diaphragm 10 after the pump was stopped for three months at 23° C. in a position where the stress on the diaphragm was 0% (in the term of the percentage to the stress corresponding to the elastic limit). Ultraviolet ray curing ink of the composition shown in table 2 was used.

TABLE 3

| material (swelling ratio) | fluoro-rubber (1.05) | silicone rubber (1.01) | natural rubber (0.95) | NBR (1.65) | urethane rubber (1.45) |
|---|---|---|---|---|---|
| deformation-deterioration (pump performance) | ○ | ○ | ○ | x | x |

wherein ○ represents that the diaphragm 10 was not deformed,
and x represents that the diaphragm 10 was deformed to such an extent that the pump performance was unacceptable.

wherein ○ represents that the diaphragm 10 was not deformed, and x represents that the diaphragm 10 was deformed to such an extent that the pump performance was unacceptable.

As can be understood from table 3, when the diaphragm 10 is of a material whose swelling ratio to the ink is not larger than 1.05, the initial performance of the pump 1 can be held for a long time.

In addition, all of the contents of Japanese Patent Application No. 11(1999)-229615 are incorporated into this specification by reference.

What is claimed is:

1. A stencil printer comprising:

an ink supply pump comprising a diaphragm pump having a diaphragm operable between a first position preventing fluid flow of an ink and a second position permitting fluid flow of the ink therethrough; and a drive assembly for driving said diaphragm between said first and second positions, wherein said diaphragm is driven by said drive assembly such that a stress applied to the diaphragm is limited to less than 75% of the elastic limit of the diaphragm.

2. A stencil printer as defined in claim 1 in which the drive assembly is configured to stop in a position where the stress applied to the diaphragm of the diaphragm pump is less than 75% of the elastic limit of the diaphragm.

3. A stencil printer as defined in claim 1 in which the drive assembly is configured such that the maximum stress applied to the diaphragm during operation of the diaphragm pump is less than 75% of the elastic limit of the diaphragm.

4. A stencil printer as defined in claim 1 wherein said diaphragm is composed of fluoro-rubber or natural rubber.

5. A stencil printer as defined in claim 1 wherein said ink comprises an ultraviolet ray curing ink.

6. A stencil printer comprising an ink supply pump in the form of a diaphragm pump, said diaphragm pump including a diaphragm composed of a material whose swelling ratio to the ink is not larger than 1.05, wherein the maximum stress applied to the diaphragm during operation of the diaphragm pump does not exceed 75% of the elastic limit of the diaphragm.

7. A stencil printer comprising an ink supply pump for ultraviolet curing ink, said ink supply pump being in the form of a diaphragm pump configured so that the maximum stress applied thereto during operation does not exceed 75% of the elastic limit of the diaphragm pump.

* * * * *